United States Patent [19]

Friedman

[11] 3,998,151

[45] Dec. 21, 1976

[54] ROTARY MARKING TOOL

[76] Inventor: Jerome Friedman, 39-39 29th St., Long Island City, N.Y. 11101

[22] Filed: June 4, 1975

[21] Appl. No.: 583,775

[52] U.S. Cl. ..... 101/6; 101/23; 101/235

[51] Int. Cl.[2] ..... B44B 5/02

[58] Field of Search ..... 101/22, 23, 5–7, 101/28, 234, 235

[56] References Cited

UNITED STATES PATENTS

| | | | |
|---|---|---|---|
| 1,978,330 | 10/1934 | Scholtes | 101/28 |
| 2,417,865 | 3/1947 | Douglass | 101/7 |
| 2,676,534 | 4/1954 | Norris et al. | 101/28 |
| 2,996,977 | 8/1961 | Friedman | 101/7 |
| 3,053,172 | 9/1962 | King | 101/7 |
| 3,487,777 | 1/1970 | Friedman | 101/7 |
| 3,640,212 | 2/1972 | Friedman | 101/7 |

*Primary Examiner*—Clifford D. Crowder
*Assistant Examiner*—William Pieprz
*Attorney, Agent, or Firm*—Philip Sands

[57] ABSTRACT

A rotary marking tool in which a marking wheel having raised characters for marking a workpiece is rotatably connected to one face of a block, is disclosed. Cooperating with the marking wheel is a pawl pivotally connected likewise to the block adjacent to the marking wheel. A tension spring is anchored at its opposite ends to a portion of the pawl and to a stop-pin affixed to the marking wheel, the spring acting to urge a beak of the pawl against the periphery of the marking wheel, whereby the stop-pin on the marking wheel is urged into contact with an abutment on the block to, thereby, define an at-rest position of the marking wheel. Upon rotation of the marking wheel in a direction away from its at-rest position, the beak of the pawl is adapted to penetrate a notch formed in the periphery of the marking wheel remote from the stop-pin. Once the beak penetrates the notch, the wheel is prevented from continuing its rotation away from its at-rest position. However, the pawl can be manually pivoted to remove the beak from the notch and, thereby, allow the spring to return the wheel to its at-rest position.

2 Claims, 4 Drawing Figures

ROTARY MARKING TOOL

BACKGROUND OF THE INVENTION

The present invention relates generally to the variety of tools commonly known as "rotary marking tools", and more particularly to the type of such tool which includes a wheel having on the periphery thereof raised characters for marking a workpiece with impressions in the form of the raised characters.

The present invention is an improvement over such tools as disclosed in U.S. Pat. No. 2,996,977, issued on Aug. 22, 1961 to Jerome Friedman. In the aforementioned patent, the tool is disclosed as having a block upon which is rotatably connected a marking wheel having raised characters on the periphery thereof for marking a workpiece in the form of the raised characters. A pawl is pivotally connected likewise to the block adjacent to the marking wheel and terminates in a beak which remains in contact with the periphery of the marking wheel. The means for urging the beak of the pawl into engagement with the periphery of the wheel is a tension spring disposed along the outside of the wheel and having one end anchored to the pawl and an opposite end anchored to an outer or exposed extension of a stop-pin affixed to the marking wheel eccentrically of the axis of rotation of the wheel.

The stop-pin is engageable in one direction of the rotation of the marking wheel with an abutment provided on the block for defining at-rest position of the marking wheel. A notch is formed on the periphery of the marking wheel remote from the stop-pin and is adapted to received the beak of the pawl when the marking wheel is rotated a distance away from its at-rest position. When the beak of the pawl penetrates the notch in the marking wheel, it prevents the marking wheel from rotating further away from the at-rest position thereof.

A disadvantage associated with the tool disclosed in the aforementioned patent results from the need to often move the marking wheel axially thereof into close proximity with a collet or workpiece holder for purposes of marking the workpiece adjacent to the collet. However, the construction of the marking wheel is such that it cannot be moved into close proximity with the collet ("close proximity" meaning, for example, approximately 0.015 inches axially away from the collet). This is because a pulley projects axially outwardly from the end face of the marking wheel and interferes with the juxtaposition of the wheel close to the collet.

The pulley is affixed to and rotatable with the marking wheel, and has a circumferentially disposed groove. That groove is adapted to receive the tension spring which interconnects the pawl and marking wheel to one another (on the outside face of the wheel) and expands during the rotation of the marking wheel away from its at-rest position. Thus, interference is caused not merely by the existance of the pulley, but also by the disposition of the tension spring on the outside face of the marking wheel.

Another disadvantage associated with the tool disclosed in the aforementioned patent is that since the tension spring which interconnects the pawl and the marking wheel to one another is mounted along the outside face of the wheel it is continuously exposed not only during the period of use of the tool, but likewise during the period in which the tool is manually handled prior to or after its use. As a result, the spring may be damaged should it inadvertently snag upon adjacent apparatus when used or if dropped or otherwise mishandled by its user.

SUMMARY OF THE INVENTION

Accordingly, it is an object of the present invention to obviate the aforementioned disadvantages associated with the tool disclosed in the aforementioned patent.

With the above object in view, it is an object of the present invention to conceal the tension spring which interconnects the pawl and the marking wheel to one another so that such tension spring will not inadvertently snag with adjacent equipment or be otherwise damaged when inadvertently mishandled.

Similarly, it is an object of the present invention to eliminate the pulley upon which the aforementioned tension spring slides as it expands when the marking wheel is rotated away from its at-rest position. The elimination of the pulley (and likewise the concealment of the aforementioned tension spring) will permit the marking wheel to be axially moved into close proximity with a collet so that the end portion of a workpiece held by the collet can be approximately marked by the raised characters on the periphery of the marking wheel.

With the above objects in view, as well as other objects, the present invention is so structured that the block, upon which is rotatably connected the marking wheel and the pawl, is provided with an end face in which is formed a slot for confining the tension spring which interconnects the pawl and the marking wheel to one another. The slot communicates with an arcuate frontal portion of the block along and over which the stop-pin affixed to the marking wheel traverses in spaced relation during rotation of the wheel away from its at-rest position, and to which stop-pin one end of the tension spring is anchored. The arcuate frontal portion of the block is guarded by the marking wheel and presents an entirely rounded stationary surface, generally concealed by the marking wheel, against which the tension springs slides during expansion and contraction and, thereby, prevents the tension spring from snagging and being stretched inadvertently beyond its elastic limit.

BRIEF DESCRIPTION OF THE DRAWINGS

The above and additional objects and advantages of the present invention will be more clearly understood from the following detailed description thereof when read in conjunction with the accompanying drawings, in which.

DETAILED DESCRIPTION OF THE INVENTION

Figure 1:
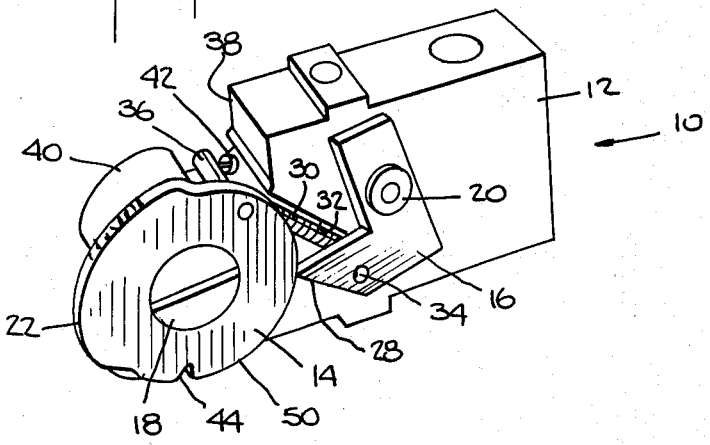
FIG. 1 is a perspective view of the tool of the present invention.

Referring now to the drawings, the present invention relates to a rotary marking tool generally denoted by the reference character 10. The tool 10 includes a block 12 upon which is rotatably connected a marking wheel 14 and a pawl 16 adjacent to one another. The marking wheel 14 is connected to the block 12 by means of a slotted, flat-headed screw 18 whose end surface lies flush with or in the same plane as the plane of the exposed end face of the wheel 14. It will be understood that the screw 18 has a stepped-down cylindrical bearing surface (not shown) which rotatably anchors a countersunk portion (not shown) of the wheel 14 to the block 12. The pawl 16 is simply pivotally connected to the block 12 by means of an appropriate pin 20 or the like.

The marking wheel 14 is provided with an at least partially cylindrical periphery 22 upon which are disposed raised characters (of alphabetical or numerical nature) for marking in their form a workpiece 24 (FIG. 3) held by a conventional collet or workpiece holder 26. The pawl 16 terminates at one end thereof in a pointed beak 28 which is urged continually into contact with the periphery of the marking wheel 14 by means of a coil-like tension spring 30.

The spring 30 is interposed between the block 12 and the pawl 16, and likewise between block 12 and the marking wheel 14, by being disposed in a slot 32 formed in an end face of the block 12 to which are pivotally connected the pawl 16 and the marking wheel 14. One end of the spring 30 is anchored to the inner or concealed surface of the pawl 16 by means of a pin 34 which projects axially into the slot 32. The opposite end of the spring 30 is anchored to a stop-pin 36 mounted on the marking wheel 14 and which projects axially toward the block 12 and into a cut-out 38 defining an arcuate frontal portion 40 of the block 12.

Disposed in the cut-out 38 of the block 12 is an endwise adjustable abutment screw 42 against which the stop-pin 36 is engageable to define with the latter an at-rest position of the marking wheel 14. It is the spring 30 which, because of the end connection thereof to the pawl 16 and the stop-pin 36, urges the beak 28 of the pawl 16 into continuous contact with the periphery of the marking wheel 14 and, thereby, urges the wheel 14 continually to its at-rest position at which the stop-pin 36 engages the adjustable abutment screw 42.

Remote from the stop-pin 36, there is formed in the periphery of the marking wheel 14 a triangular-like notch 44 into which the beak 28 of the pawl 16 will shift when the marking wheel 14 is rotated a selected distance in a direction away from its at-rest position. The beak 28, when penetrating the notch 44, prevents further rotation of the marking wheel 14 away from its at-rest position.

During the rotation of the marking wheel 14 away from its at-rest position, the spring 30 expands and sides along the arcuate frontal portion 40 of the block 12. In order to prevent the spring 30 from snagging and being stretched beyond elastic limit by any sharp edges that it may contact during its expansion (or contraction), the arcuate frontal portion 40, over its entire surface area that the spring 30 contacts during expansion and contraction, presents an entirely rounded stationary surface against which the spring rides.

Figure 4:
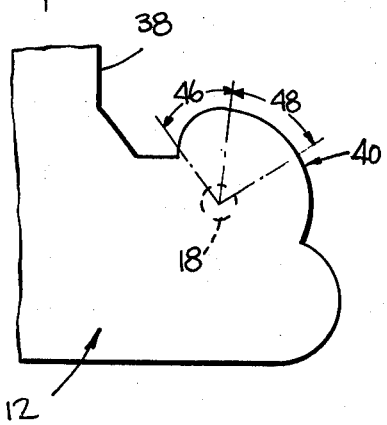
FIG. 4 is a schematic, fragmentary view illustrating the opposite side of the tool of the present invention from which is absent the marking wheel.

The cross-sectional configuration of the arcuate frontal portion 40 is best illustrated in FIG. 4. The portion 40 includes a first surface section 46 and a second surface section 48, the surface section 48 having a greater radius of curvature than the surface section 46. The surface section 46 is upstream of the surface section 48 and is in greater proximity to the at-rest position of the marking wheel 14. The surface section 46, thus, constitutes the initial snag-proof surface of the arcuate frontal portion 40 to be contacted by the spring 30 when the marking wheel 14 is rotated away from its at-rest position.

Preferably, though not necessarily, at least the surface section 48 is circular in cross-section, thereby presenting a path along which rides the spring 30 corresponding to the circular path traversed by the stop-pin 36 when the marking wheel 14 is rotated away from its at-rest position. By this mode, the spring 30 is not subjected to any sharp or abrupt turns during its expansion and contraction which might otherwise cause it to snag and be stretched beyond its elastic limit, the marking wheel 14 also offering protection for, or guarding, the spring 30 against snagging with adjacent equipment.

Figure 2:
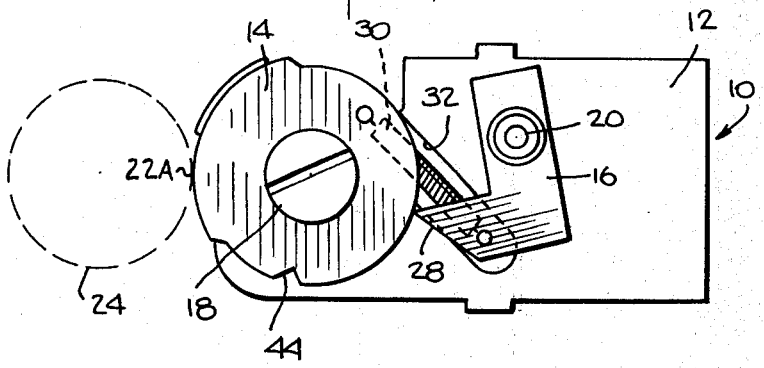
FIG. 2 is a schematic, side view of the tool of the present invention.
Figure 3:
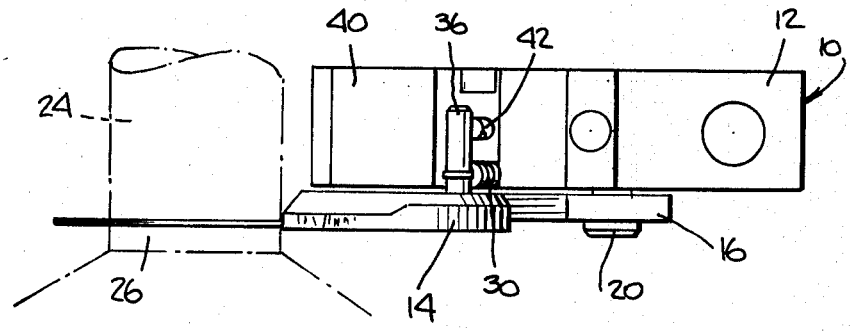
FIG. 3 is a schematic, plan view of the tool of the present invention.

In operation, as illustrated in FIG. 3, the tool 10 may be adjusted both radially and axially of the marking wheel 14 into close proximity with a workpiece 24 held by a collet 26, for example, 0.015 inches axially away from the collet 26 to mark the end of the workpiece 24 held by the collet 26. The tool 10 is moved radially of the workpiece 24 until a "cam rise" or an every-so-slight high spot 22A (FIG. 2) on the periphery 22 is pressed against the cylindrical surface of the workpiece 24. The marking operation may then proceed by turning the collet 26. When the collet 26 is turned to thereby turn the workpiece 24, the cam rise 22A causes the marking wheel 14 to turn and, thereby, the raised characters on the periphery of the wheel 14 in succession imprint their respective forms into the workpiece 24.

However, the periphery of marking wheel 14 is provided with a portion 50 of reduced diameter so that at the end of the marking operation, when the wheel 14 is moved into a position where the portion 50 thereof of reduced diameter is moved out of contact with the workpiece 24, the wheel 14 can terminate its rotation. Inertia, however, for example, may cause the marking wheel 14 to continue to rotate slightly after the periphery thereof has moved out of contact with the workpiece 24. Continued rotation of the marking wheel 14 will move the notch 44 thereof into a position at which the beak 28 of the pawl 16 will penetrate the notch 44 and terminate the rotation of the marking wheel 14, the notch 44 being located in the portion 50 of reduced diameter.

With the marking wheel 14 in a position wherein the notch 44 thereof is held by the beak 28, the tool 10 can be safely moved away from the workpiece 24 without damaging the latter. With the tool 10 so removed from the workpiece 24, the pawl 16 can be manually pivoted to remove the beak 28 thereof from the notch 44 and permit the tension spring 30 to urge the marking wheel 14 to its at rest position at which the stop-pin 36 contacts the abutment 38. The workpiece 24 can then be removed from the collet 26 and be replaced by a new workpiece to be marked by the tool 10.

It will be understood that the foregoing description of a preferred embodiment of the present invention is for purpose of illustration only, and that the various structural and operational features and relationships herein disclosed are susceptible to a number of modifications and changes none of which entails any departure from the spirit and scope of the present invention as defined in the hereto appended claims.

What is claimed is:

1. A rotary marking tool comprising a block, a marking wheel rotatably connected to one side of said block, said wheel including on the periphery thereof raised characters for marking a workpiece, a stop-pin affixed to and eccentrically of the axis of rotation of said wheel, said block including an arcuate frontal portion along and over which said stop-pin traverses in spaced relation during rotation of said wheel, said block further including abutment means adjacent to said arcuate frontal portion for being engaged by said stop-pin in one direction of the rotation of said wheel, an elongate slot formed in said side of said block and terminating with an open end at said arcuate frontal portion, a tension spring disposed in said slot and terminating in one end which is anchored to said stop-pin, a pawl pivotally connected to said side of said block adjacent to said wheel and terminating in a beak, the other end of said spring being anchored to said pawl and urging said beak against said wheel perphery whereby said wheel is rotatably urged to an at-rest position at which said stop-pin and abutment means engage one another, a notch formed in said wheel periphery remote from said stop-pin, said spring also urging said pawl to pivot to a position at which said beak penetrates said notch when said wheel is rotated in a direction opposite of said one direction and away from said at-rest position, said beak when penetrating said notch preventing further rotation of said wheel away from said at-rest position, said arcuate frontal portion of said block presenting an entirely rounded stationary surface against which said spring slides during expansion and contraction and, thereby, preventing the latter from snagging and being stretched beyond its elastic limit, said arcuate frontal portion including a first surface section of rounded cross-section, and a second surface section of rounded cross-section but having a smaller radius or curvature than said first surface section, said second surface section being more proximate to said at-rest position of said wheel and constituting the initial snag-proof surface of said arcuate frontal portion to be contacted by said spring when said wheel is rotated away from said at-rest position.

2. A rotary marking tool as claimed in claim 1, wherein said wheel includes a pair of axially opposite flat side-faces.

* * * * *